United States Patent [19]

Hersey

[11] 4,220,836

[45] Sep. 2, 1980

[54] PRESSURE RESPONSIVE CONTROL UNIT EMPLOYING SNAP ACTION DIAPHRAGM

[75] Inventor: Harold E. Hersey, Columbus, Ohio

[73] Assignee: Ranco Incorporated, Columbus, Ohio

[21] Appl. No.: 971,517

[22] Filed: Dec. 20, 1978

[51] Int. Cl.[2] ..... H01H 35/34

[52] U.S. Cl. ..... 200/83 P; 92/103 M; 200/83 S; 73/378.3

[58] Field of Search ..... 73/378.3; 92/7, 13.2, 92/94, 101, 104, 103 M; 200/83 R, 83 A, 83 J, 83 S, 83 SA, 83 P, 83 N, 83 Q

[56] References Cited

U.S. PATENT DOCUMENTS

| | | | |
|---|---|---|---|
| 3,330,925 | 7/1967 | Andrew | 200/83 P |
| 3,335,242 | 8/1967 | Johnson | 200/83 P |
| 3,588,395 | 6/1971 | Hersey | 200/83 S |
| 3,864,537 | 2/1975 | Fiore | 200/83 S |

*Primary Examiner*—Gerald P. Tolin

*Attorney, Agent, or Firm*—Watts, Hoffmann, Fisher & Heinke Co.

[57] ABSTRACT

A control unit is disclosed comprising a pressure transducer assembly and an attached output switch assembly. The transducer includes rigid body members clamped together and defining a chamber between them, a snap acting diaphragm extending through the chamber, and high and low pressure event controlling mechanisms for adjusting the pressure levels at which the diaphragm snap moves. A motion transfer pin extends from the transducer to the switch assembly to operate a control switch in response to diaphragm motion.

14 Claims, 5 Drawing Figures

PRESSURE RESPONSIVE CONTROL UNIT EMPLOYING SNAP ACTION DIAPHRAGM

BACKGROUND

1. Field of the Invention

The present invention relates to differential pressure responsive control units and more particularly to differential pressure responsive control units which can be set to respond to predetermined differential pressure levels.

2. Prior Art

Differential pressure responsive control units employing snap acting diaphragms for actuating a control switch, valve member, or the like have been proposed in the past. Generally speaking these kinds of units were constructed using housings which communicated a source of pressure being monitored to one side of a snap diaphragm while the other side of the diaphragm was exposed to some reference pressure, such as atmospheric air. The diaphragm motion was typically transmitted to the control switch or valve by an operating pin so that when the monitored pressure increased sufficiently above the reference pressure the diaphragm snap moved to alter the condition of the switch or valve member, etc. When the sensed differential pressure acting on the diaphragm reached a second level the diaphragm snapped to its alternate position resulting in the switch or valve member resuming its initial condition.

Pressure responsive units employing snap acting diaphragms have been desirable because they are of relatively simple construction and can be manufactured inexpensively; but such units have usually had to be utilized in environments where sensed differential pressure levels effective to shift the diaphragm can vary relatively widely from nominal values. The relatively wide tolerance requirements for their usage were due to inability to calibrate some designs with sufficient accuracy and inadequately strong diaphragm mounting and support in the control units themselves. For these reasons such controls could not always be relied upon to respond to sensed pressure levels required for many end uses.

Attempts have been made to construct snap diaphragm units which could be calibrated to respond more closely to predetermined sensed pressures, but these have not been uniformly successful. Generally, approaches to presetting the differential pressure levels at which the diaphragms snapped between alternate positions have involved establishing a desired operating differential pressure across the diaphragm and then permanently deforming the diaphragm itself, and/or shifting diaphragm supporting elements in the unit, until the diaphragm snapped to the alternate position. Theoretically at least, such diaphragms would thereafter snap to the alternate position at a consistent applied differential pressure; however, in practice the calibration procedures did not achieve sufficient accuracy on a consistent basis.

In some of these proposals, for example, the diaphragm supporting housing members were mechanically deformed to deform the diaphragm and alter its response to pressure. This kind of calibration was often difficult to control and required the use of housing constructions which were relatively weak and subject to yielding during the useful life of the control. Moreover, critical weld joints were required in some of these kinds of units and the weld integrity often could not be assured until after calibration since the area of the weld was yielded during the calibration. Many such control units had to be completely assembled, including an associated switch assembly, before calibration and pressure testing.

These controls were particularly subject to drifting from calibrated settings when exposed to automotive type environments where ambient operating temperatures for the controls vary from −40° to 121° C. (−40° to 250° F.). The controls can also be subjected to sustained high pressure at temperature as well as mechanical shocks and vibration in the automotive environments.

Other approaches to diaphragm calibration also resulted in the diaphragms being subjected to stresses which eventually caused fatigue failure of the diaphragm. For example, in some prior art proposals adjusting screws were advanced into engagement with the central sections of diaphragms to limit their travel. The screws were impacted by the diaphragms during their travel which tended to both overstress the diaphragm material in the vicinity of the screw and to loosen and change the position of the adjusting screw.

Furthermore the adjustment screws were themselves only subject to loading when engaged by a diaphragm and tended toward being advanced or retracted from their adjusted positions particularly when subjected to vibrations of the sort encountered in automotive vehicles, houshold appliances and so forth. This caused the control units to drift from their calibration settings.

Other similar proposals involved providing a deformable member which extended peripherally along and engaged the diaphragm in one of its positions. The deformable member was engaged by a similarly shaped threaded member which was turned to deform the member and control its engagement with the diaphragm. This kind of adjustment scheme tended to fatigue the diaphragm and to unduly stress the diaphragm along the region of its engagement with the deformable member. Furthermore when the member was deformed to calibrate the pressure level at which the diaphragm snapped away from the deformable member, the pressure at which the diaphragm snapped toward engagement with the diaphragm tended to be altered as well.

Some pressure responsive controls of the sort referred to were constructed to respond to applied differential pressures having first and second predetermined levels. In order to enable the controls to respond to a predetermined relatively high level pressure, the position of the diaphragm when dished into a sealed chamber section of the control had to be adjustable, at least for calibration purposes.

Because the diaphragm was usually dished into the sealed chamber during assembly of the controls, the adjustment structure had to be constructed to enable the diaphragm to extend sufficiently into the sealed chamber section to enable its subsequent calibration. Accordingly various structures were proposed including calibration screws which exhibited the problems referred to above.

In still other proposals a plunger was spring biased into engagement with the diaphragm. The spring force was adjustable to enable calibration of the controls by increasing the biasing force on the plunger. These proposals did not always produce highly accurate pressure responses because biased plungers did not form positive diaphragm stops.

In addition to the problems attendant prior art diaphragm calibration and support structures, many prior art pressure controls did not adequately support the diaphragms around the periphery of the dished central portions. In some constructions the control assembly itself was not rigid enough to insure against the diaphragm shifting over a number of cycles and this "drifting" from the calibrated setting.

SUMMARY OF THE INVENTION

The present invention provides a new and improved pressure responsive control unit employing a snap acting differential pressure responsive diaphragm, the unit being so constructed and arranged that the diaphragm consistently responds to predetermined sensed differential pressure levels after a large number of cycles of operation, and notwithstanding the unit being subjected to over-pressure conditions, vibrations and extremes of ambient temperature.

According to a preferred embodiment of the invention the new control unit includes a pressure transducer assembly having first and second rigid body members defining a chamber between them with a snap acting diaphragm extending across the chamber. The diaphragm is hermetically bonded to one body member so that it can move from one side of the chamber toward the other in response to differential pressure forces acting on it. A pressure event controlling mechanism is employed for adjustably calibrating the differential pressure level at which the diaphragm snaps in one direction. The controlling mechanism includes a diaphragm supporting member and an adjusting member. The diaphragm supporting member is anchored between the body members and defines a smooth diaphragm engaging face extending substantially across the chamber. The adjusting member reacts between the supporting member and its associated body member and resiliently deflects the diaphragm supporting member between adjusted positions to enable control unit calibration.

The diaphragm supporting member is a strong, stiffly resilient plate-like structure having its outer periphery engaged with and supporting the diaphragm periphery so that the bond between the housing member and diaphragm is rigidly supported and isolated from stresses and straining which could otherwise be caused by the differential pressures applied to the diaphragm. The supporting member is resiliently deflected by the adjusting member in the vicinity of the center of the diaphragm and rigidly bears against the diaphragm at a location between the diaphragm center and the bond. The bearing engagement between the diaphragm supporting plate and the diaphragm assure consistently accurate snap movement of the diaphragm. The location of bearing engagement with the diaphragm is spaced from the diaphragm center so that it moves relatively little when the adjusting member shifts the central portion of the supporting plate.

The pressure transducer formed by the body members, diaphragm and controlling mechanism is assemblable for calibration setting without requiring the presence of an output device, such as a switch assembly. The structural strength of the body members is such that the spring forces created by deflection of parts in the unit and applied fluid pressure forces are borne by the body members without requiring assembly of an output device to the transducer assembly for calibrating it.

In a preferred embodiment of the invention a second pressure event controlling mechanism is provided for assuring that the diaphragm snap moves to the supporting plate when a predetermined relatively high differential pressure is applied to it. The second pressure event controlling mechanism includes a shiftable diaphragm support member and an adjusting member reacting between the housing and the diaphragm support member. The diaphragm support member is initially fixed in the housing so that it is spaced from the diaphragm to facilitate bonding the diaphragm to the housing. The adjusting member deflects the diaphragm support member to an adjusted position where the diaphragm, engaged by the support member, responds to a predetermined differential pressure level by snap moving away from engagement.

The adjusting member is preferably moved by operation of a screw and the diaphragm support member is constructed and arranged to resiliently engage the adjusting member at all times after calibration so that the adjusting member position is maintained by the support member engagement. This assures that the diaphragm support member and its adjusting member are maintained in their adjusted positions even when subjected to relatively severe vibrations.

The body members are fixed to each other with the diaphragm and controlling mechanisms assembled in place. The assembly is calibrated by subjecting the diaphragm to differential pressures and adjusting the differential pressure level control mechanisms so that the diaphragm snaps from one position to another when predetermined pressure differentials are established.

One of the body members defines a locating surface against which output device assembly is attached. A motion transmitting pin extends between the diaphragm and the output device so that operation of the diaphragm causes some output indication. The output assembly is, in the preferred embodiment, a switch whose conductive state is altered when the diaphragm operates. The switch housing abuts the body member locating surface so that an accurately fixed relationship exists between the assemblies.

Other features and advantages of the invention will become apparent from the following detailed description of a preferred embodiment made with reference to the drawings which form part of the specification.

DESCRIPTION OF A PREFERRED EMBODIMENT

Figure 1:
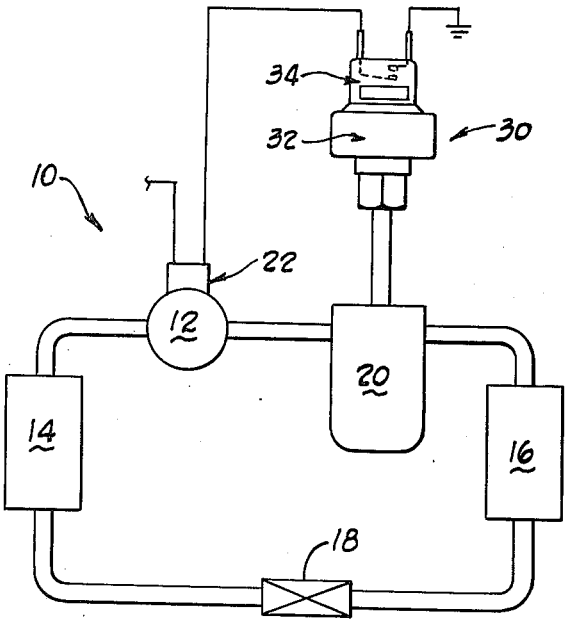
FIG. 1 is a schematic illustration of a refrigeration system employing a control unit constructed according to the present invention.

An automotive air conditioning system 10 employing a pressure responsive control unit constructed according to the present invention is illustrated by FIG. 1. The system 10 is a conventional compressor-condenser-evaporator system including a refrigerant compressor 12, a condenser 14, an evaporator 16 and an expansion valve or throttling orifice 18 between the condenser and evaporator. The refrigerant compressor 12 compresses gaseous refrigerant and discharges it to the refrigerant condenser 14 which functions to transfer heat from and liquefy the refrigerant. As the liquefied refrigerant flows through the expansion valve 18 it is vaporized and as it passes through the evaporator absorbs heat. This heat absorption results in the evaporator cooling its surroundings. The relatively low pressure gaseous refrigerant exiting the evaporator 16 returns to the inlet of the compressor 12 and in the illustrated system a refrigerant accumulator 20 is disposed between the evaporator and compressor to accommodate changes in volume of the refrigerant in the system created by environmental temperature changes, etc.

The compressor 12 is driven from the vehicle engine through an electrically operated clutch shown schematically and indicated by the reference character 22. Operation of the clutch 22 is governed by various control switches to assure that the compressor 12 is not driven from the engine when undesirable. The clutch 22 is typically connected in a circuit with the vehicle power supply such as a battery (not shown) and a manually operated switch (not shown) associated with the ignition switch which prevents the compressor 12 from being driven during cranking of the vehicle engine and a pressure responsive control unit 30, constructed according to the invention.

The control unit 30 is illustrated as connected in pressure communication with the accumulator 20 and is effective to interrupt and close the clutch energizing circuit in response to detection of predetermined refrigerant pressure levels relative to atmospheric pressure. For example, the pressure control unit 30 can be set to cut in, or energize, the clutch 22 when the refrigerant pressure rises to 46 pounds per square inch greater than atmospheric pressure and maintain the clutch energized until the refrigerant pressure falls below 26 pounds per square inch in excess of atmospheric pressure.

This operation enables cycling of the compressor because the refrigerant pressure detected by the control unit 30 is reflective of the refrigeration load on the system 10. When the system refrigeration load is small the air flowing past the evaporator is relatively cool and the refrigerant passing through the evaporator absorbs less heat than it otherwise would. Hence the pressure detected by the control unit 30 is reduced relative to atmospheric air pressure, causing the clutch to be deactivated. When the air passing the evaporator is relatively warm, signifying a greater system refrigeration load, the refrigerant in the evaporator is heated and the pressure detected by the control unit 30 rises until the clutch is reactivated and the compressor operates again.

The control unit 30 also protects the compressor from damage as a result of being operated when the quantity of refrigerant filling the system 10 is inadequate. Inadequate refrigerant supply causes the control unit 30 to detect low refrigerant pressure and terminate operation of the compressor. In addition the control unit 30 discontinues operation of the compressor when ambient atmospheric temperatures are sufficiently low that refrigerant pressure falls below the predetermined low level. Operation of the compressor is generally unnecessary at low atmospheric temperatures.

Figure 2:
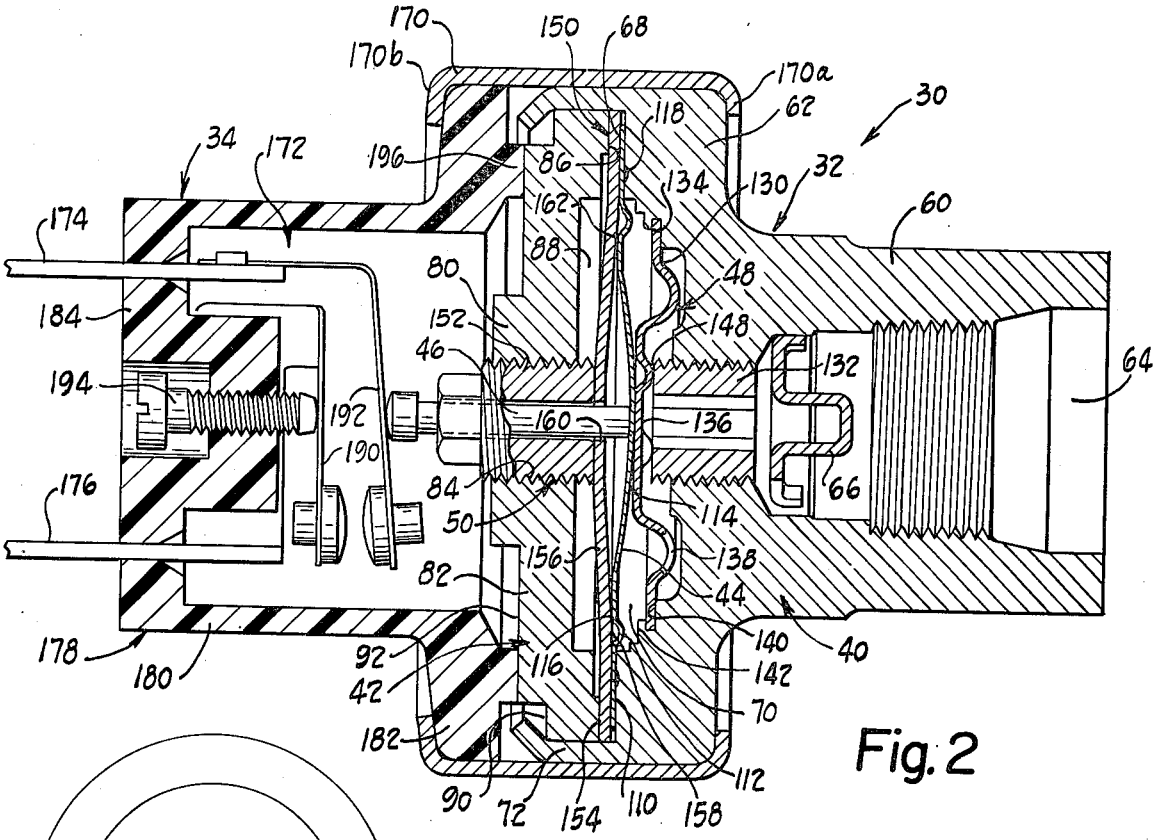
FIG. 2 is a cross sectional view, with some parts illustrated in elevation, of a control unit constructed according to the invention.
Figure 4:
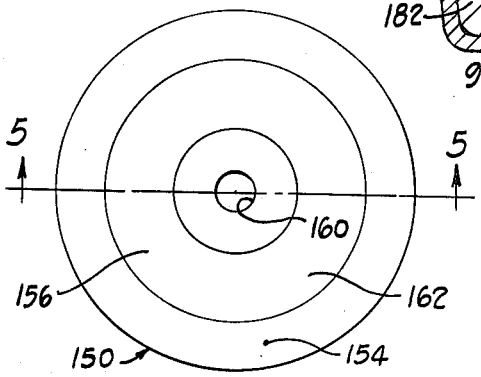
FIG. 4 is an elevational view of a component part of the unit of FIG. 2.

The illustrated and preferred control unit 30 comprises a differential pressure responsive transducer assembly 32 and an output assembly 34 the latter being, in the preferred embodiment, formed by an electrical switch assembly for completing and interrupting the clutch energizing circuit. Referring to FIG. 2 of the drawings the pressure transducer assembly 32 includes first and second body members 40, 42, respectively, a pressure responsive snap acting diaphragm 44 which coacts with a diaphragm motion transmitting pin 46 to operate the output assembly 34, and high and low pressure event controlling mechanisms 48, 50, respectively, for controlling the differential pressure levels at which the diaphragm snap moves between alternate positions.

The body member 40 is a rigid, structurally strong member preferably formed from steel and includes a generally cylindrical base 60 having a flange 62 at one end and a through opening 64 extending along the axis of the base. The base opening 64 is internally threaded so that it can be screwed into place on a tube or valve stem of the refrigeration system 10 and the base may be provided with a sheet metal valve stem depressor 66 in the event the control unit 30 is used with a Schrader or similar valve of the same general type used to govern inflation of automotive tires.

The flange 62 includes a bearing structure 68 which, in the preferred embodiment, is defined by an annular planar face disposed in a plane perpendicular to the axis of the base, a recessed section 70 radially inwardly from the bearing structure 68 and a cylindrical clamping wall 72 disposed radially outwardly from the bearing structure and projecting axially beyond the plane of the bearing face 68.

The body 42 is constructed from structurally strong, rigid material like the body 40 and includes a base 80, a flange 82 extending outwardly from the base and a central through opening 84. The illustrated flange 82 includes a bearing structure 86 forming an annular face confronting the bearing structure 68 and a recessed section 88 radially inwardly from the bearing structure 86. The opposite axial side of the flange 82 includes a peripheral clamping shoulder 90 and a rear locating surface 92 upon which the output assembly 34 is mounted in a fixed relation to the pressure transducer assembly.

The body members 40, 42 are firmly clamped together with the recessed sections 70, 88 aligned to define a chamber between the body members. As illustrated by FIG. 2, the body members are assembled with the bearing structures 68, 86 aligned and the clamping wall 72 is peened over about the clamping shoulder 90 so that the body members are tightly clamped in the assembled condition.

The diaphragm 44 is preferably formed from a thin sheet of spring metal and extends across the chamber to form, with the recessed sections 70, 88, separate chamber sections on its opposite sides. The chamber section associated with the body member 40 communicates with referigerant in the system 10 via the opening 64 while the other chamber section is vented to ambient atmospheric pressure via the opening 84. The diaphragm 44 snap moves back and forth between the chamber sections depending upon the level of differential fluid pressure across the diaphragm.

In the preferred embodiment the diaphragm 44 comprises an outer marginal section 110 formed by a planar annular rim, a circumferential corrugation 112 which projects into the chamber toward the body member 40, a central dished section 114 engaging the motion transmitting pin 46 at its center, and a narrow annular transition section 116 between the dished section 114 and the corrugation 112.

The outer marginal diaphragm section 110 is connected to the bearing structure 68 by a hermetic bond, indicated by the reference character 118, which extends continuously about the diaphragm. In the preferred and illustrated embodiment the bond 118 is a narrow weld joint created by scanning a laser beam around the diaphragm so that the diaphragm material is melted and fused to the body 40 essentially along a narrow line of contact. The corrugation 112 provides for absorbing and reducing stresses applied to the disc during welding and when the diaphragm is clamped between the body members.

The diaphragm central section abruptly reverses its curvature in response to the existence of predetermined pressure force levels acting on it and in so doing snap moves between its stable positions. As the diaphragm central section moves between its oppositely dished conditions the central section outer periphery expands and the expansion is accommodated by resilient deepening of the corrugation 112 until the central section passes through center, i.e., becomes flat, after which the central section periphery is again reduced.

The diaphragm forms a spring which, in the illustrated unit, is biased toward its dished position illustrated by FIG. 2. When the refrigerant pressure force acting on the diaphragm exceeds the sum of the atmospheric pressure force, the biasing force of the diaphragm itself and the force transmitted to the diaphragm by the pin 46, the central section snap moves so that it is dished away from the body member 40. In this position the diaphragm central section has reversed its curvature, or snapped over-center, and the biasing force of the diaphragm spring is substantially reduced.

The diaphragm returns to its illustrated position when the refrigerant pressure force level is less than the algebraic sum of the atmospheric pressure force, the diminished diaphragm biasing force and the force exerted by the pin 46. The difference in magnitude of the diaphragm biasing forces determines the differential between the refrigerant pressures at which the diaphragm moves. In a typical system 10 employing a refrigerant such as that known as R12 the respective refrigerant pressures at which the diaphragm changes position are, for example, 26 pounds per square inch above atmospheric pressure and 46 pounds per square inch above atmospheric pressure.

It should be noted that the biasing force with the diaphragm resists shifting between its positions is reduced as the dished central diaphragm section moves toward center, i.e., toward the plane of the outer marginal portion 110. The high and low pressure event adjusting mechanisms 48, 50 function to limit the motion and displacement of the diaphragm central section away from "center" and thus control the level of the diaphragm spring biasing force. This in turn governs the refrigerant pressure levels at which the diaphgram snap movement occurs. The diaphragm 44 is formed so that, if completely unrestrained by the mechanisms 48, 50, the diaphragm will snap move from its position illustrated by FIG. 2 when refrigerant pressure is around 55 pounds per square inch above atmospheric pressure and will snap move to the FIG. 2 position when refrigerant pressure is about 18 pounds per square inch above atmospheric pressure.

The high pressure event adjustment mechanism 48 supports the diaphragm control section at a position where its biasing force is reduced to require the 46 psig refrigerant pressure to shift the diaphragm. The mechanism 48 includes a diaphragm support member 130 and an adjusting member 132 which reacts between the body 40 and the member 130 to control positioning of the diaphragm central section.

Figure 3:
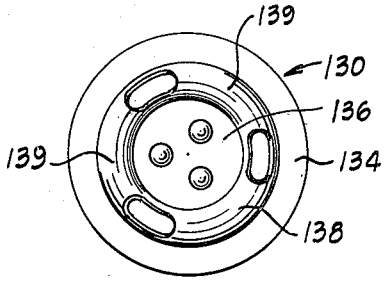
FIG. 3 is an elevational view of a component part of the unit of FIG. 2.

The member 130 engages and supports the diaphragm with minimal stress concentrations being induced in the diaphragm and is constructed and arranged particularly to facilitate assembly of the diaphragm in body member 40. Referring to FIGS. 2 and 3 the member 130 includes a peripheral base 134 anchored to the body member 40, a medial portion 136 forming a face engageable with the central diaphragm section, and a deformable resilient portion 138 between the base and medial portions for enabling the medial portion 136 to be shifted by the adjusting member 132.

The diaphragm support member 130 must be assembled to the body 40 before the diaphragm 44 is bonded in place. This creates a manufacturing problem because the diaphragm central section is, as noted, initially "overformed" and dished more deeply than it need be in order to respond to desired refrigerant pressure levels. The central section must not be engaged with the support member 130 during bonding in order to insure against stressing the weld and/or destroying the seal created by the weld.

In order to facilitate assembly, the base 134 is seated against a body member locating shoulder 140 and firmly staked in place by upsetting body material, indicated by the reference character 142, along the base periphery. The resilient portion 138 is formed by an annular corrugation having spaced openings defining wide struts 139 between them. The corrugation is sufficiently deep to assure the medial portion 136 is spaced from the diaphragm central section as the diaphragm is bonded to the member 40.

The adjusting member 132 is preferably a hollow screw threaded into the body member opening 64. The projecting screw end 148 engages the supporting member medial portion 136 so that as the screw advances it reacts between the body member and the diaphragm supporting member to shift the medial portion 136 toward the diaphragm. The opening through the screw 132 communicates system refrigerant pressure to the diaphragm and is shaped to receive a tool for driving the screw. In the illustrated embodiment the screw end 148 engages standoffs embossed in the medial portion 136. The standoffs avoid the possibility of the engagement between the screw end 148 and the medial portion 136 blocking pressure communication through the screw opening.

The struts 139 flex to enable substantial corrugation "rolling" when the screw 132 is advanced to move the supporting member medial portion 136 into engagement with the diaphragm. The struts 139 resiliently resist advancement of the screw so that when the diaphragm support member 130 reaches its adjusted position, illustrated by FIG. 2, the struts 139 continue to be resiliently deflected. The diaphragm support member thus both resiliently engages the screw end 148 to frictionally lock the screw in its adjusted position and and rigidly supports the diaphragm central section in position. The force exerted by the diaphragm support member on the screw maintains the screw locked in its adjusted position when the diaphragm central section is disengaged from the support member 130 notwithstanding the vibrations, temperature induced differential expansion and conraction; etc., to which the control unit is subjected in use.

The low pressure event controlling mechanism 50 supports the diaphragm after refrigerant pressure in the system has increased to a level where the diaphragm is snapped away from the support member 130. The mechanism 50 supports the diaphragm in a position where, when the refrigerant system pressure reaches a predetermined level below the high pressure event level, the diaphragm snaps back into position against the support member 130. The mechanism 50 also rigidly supports and retains the diaphragm when the refrigerant system pressure increases substantially above the high pressure event level such as when the system is exposed to relatively high ambient atmospheric temperatures at a time when it is not operating. The mechanism 50 includes a diaphragm supporting plate 50 and an adjusting member 152 for reacting between the supporting plate 150 and the body member 42.

The supporting plate 150 is formed by a relatively heavy spring metal disk having an outer annular peripheral portion 154 anchored between the body members and a stiffly resilient central portion 156 extending across the chamber defining a smoothly concave face with a small central guide opening 160 for the pin 46. The supporting plate outer peripheral portion 154 engages and supports the diaphragm 44 radially outwardly from the diaphragm corrugation 112 while the supporting plate central portion defines a narrow zone 162 of bearing contact with the diaphragm transition section 116, just inside the diaphragm corrugation.

The contact zone 162 engages the diaphragm throughout the operational pressure range of the control unit so that the diaphragm flexure is limited to the diaphragm central section radially inwardly from the zone 162. The diaphragm section 116 rolls on the bearing zone 162 at the inside diameter of the corrugation when the central section changes its curvature. Because of this motion stresses at the juncture of the diaphragm central section and the transition section 116 are reduced. It should be noted that the refrigerant pressure is always greater than atmospheric pressure so that the diaphragm engages the bearing contact zone at all times.

Figure 5:
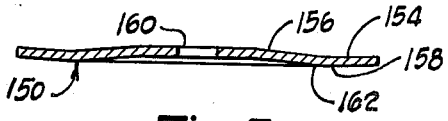
FIG. 5 is a cross sectional view seen approximately from the plane indicated by the line 5—5 of FIG. 4.

In the preferred embodiment of the invention the outer peripheral portion 154 is very slightly frustoconical and merges with the concavely curved central portion 156 at a reversely curved juncture 158 (See FIG. 5). The juncture 158 is aligned with the diaphragm corrugation so that the diaphragm does not engage the juncture 158. This avoids the diaphragm material being reversely curved by being forced into conformity with the juncture 158. Stress concentrations which otherwise would quickly fatigue the diaphragm and cause fracturing are thus avoided.

The body members 40, 42 are clamped together with sufficient force that the frustoconical peripheral plate portion 154 is flattened and urged against the diaphragm peripheral section radially outwardly from the corrugation to the diaphragm outer periphery, including that portion of the diaphragm secured to the body member 40 by the bond 118. This eliminates any tendency of the diaphragm peripheral section to toggle as a result of pressure applied to it and otherwise isolates the bond 118 from stress.

The adjustment member 152 is formed by a hollow screw threaded into the body member opening 84. The motion transfer pin 46 extends through the screw opening between the diaphragm 44 and the output assembly 34. The end of the screw 152 projecting into the chamber between the body members engages the diaphragm supporting plate central portion. As the screw is advanced the diaphragm supporting plate 150 is resiliently deflected toward the diaphragm to increase the refrigerant pressure level at which the diaphragm snaps toward engagement with the diaphragm support member 130. Retraction of the screw is accompanied by resilient return of the diaphragm support plate toward its undeflected position which in turn provides for greater diaphragm flexure and reduces the refrigerant pressure level required for the diaphragm to move away from the supporting plate.

The stiffness and structural strength of the diaphragm supporting plate 150, together with the support offered by the screw 152, firmly support the diaphragm against overstressing even under conditions where the refrigeration system pressure is extremely great. Overpressure conditions of this sort can yield an unsupported diaphragm as well as a diaphragm supported (or partially supported) by a member of lesser strength and rigidity. In cases where partially supported diaphragms are subjected to overpressure conditions the diaphragms tend to be reversely curved and fracturing of the diaphragms tends to ensue.

The supporting plate 150 resiliently engages the screw 152 constantly so that the screw is frictionally maintained in position in the body member 42 without requiring a separate thread locking device and notwithstanding vibrations to which the unit is subjected. The end of the screw 152 remote from the diaphragm projects from the body member 42 and is formed with external tool engaging flats which permit adjusting the screw's position by a suitable driving tool.

The pressure transducer assembly 32 is assembled by pressing the body members 40, 42 together and clamping them in place by deforming the clamping wall 72 to turn its projecting end portion radially inwardly to grip the clamping shoulder 90. As noted, the clamping force is sufficiently great to assure that the diaphragm supporting plate peripheral poriton 154 is flattened against the diaphragm peripheral section. The mechanisms 48, 50 are fully retracted. In this initially assembled condition the transducer assembly is stress relieved by placing it in an atmosphere at around 450° F. and maintained at temperature while the pressure in the chamber section 70 is cycled several times between atmospheric pressure and about 250 psi above atmospheric pressure.

Calibration of the pressure transducer assembly 32 involves a number of operational steps and adjustments requiring continued adjustability of the diaphragm supporting plate and the member 30. An important advantage of the control unit construction resides in the ability to accurately calibrate its pressure response characteristics before the output assembly 34 is attached to it.

In order to calibrate, the stress relieved transducer assembly 32 (with the fitting 66 removed, or not yet in place) is connected to a controllable source of pressurized calibrating gas via the body opening 64. The calibration gas source (not illustrated) is provided with a rotatable screw driving tool which extends into the high pressure event adjusting screw 132 for turning it while the source gas pressure is applied to the diaphragm 44. The calibration source pressure is elevated until the unbalanced force applied to the diaphragm is sufficiently great to move the diaphragm into engagement with the supporting plate 150 (the calibration source pressure is raised to about 55 psi above atmospheric pressure).

The low pressure event controlling mechanism 50 is then precalibrated by reducing the calibration source pressure to a few pounds per square inch less than the desired low pressure event level (about 23 psi) and the screw 152 is advanced to resiliently deflect the plate 150 and shift the diaphragm toward the high pressure event support member 130 until the diaphragm snaps into engagement with the member 130.

The high pressure event controlling mechanism 48 is next precalibrated by adjusting the calibration source pressure to a few pounds per square inch above the desired high pressure event level (for example 49 psi) and advancing the screw 132 until the diaphragm 44 snaps into engagement with the plate 150 again.

At this juncture the calibration source pressure is elevated to about 450 psi (substantially greater than the highest predictable pressure encountered during use of the control) so that the plate 150 is seated firmly against the screw 152.

The low pressure event controlling mechanism is next calibrated by reducing the calibration source pressure to the desired low pressure event level (26 psi) and advancing the screw 152 until the diaphragm 44 snaps into engagement with the member 130.

Final calibration of the high pressure event controlling mechanism 48 is accomplished by increasing the calibration source pressure to the desired high pressure event level (46 psi) and advancing the screw 132 until the diaphragm snaps back into engagement with the plate 150.

It should be noted that the resilient movement of the supporting plate central portion 156 to its calibrated position causes a slight movement of the zone of bearing contact 162 towards the member 130. This slight movement of the bearing contact zone 162 results in a change in the high pressure level at which the diaphragm is snapped away from the member 130. Accordingly the low pressure event controlling mechanism 50 must always be calibrated before the final calibration of the high pressure event controlling mechanism 48.

After the pressure event levels have been set the calibration source pressure is again increased to 450 psi briefly to assure seating the plate 150 on the screw 152. The calibration source pressure is then reduced to correspond to the low and high pressure event settings to determine whether the diaphragm snaps back and forth at the desired pressure event levels.

If the low pressure event level is not responded to within an acceptable tolerance range the calibration proceedure just outlined is repeated to recalibrate the transducer. The resilient flexure of the plate central portion 156 by the screw 152 enables recalibration since the plate 150 can readily be repositioned for the precalibration step.

If the high pressure event level is not responded to accurately enough the high pressure event controlling mechanism 48 can merely be readjusted to the desired level without affecting the calibrated low pressure event level. This is due to the fixed location of the bearing engagement between the supporting plate 150 and the diaphragm along the bearing region 162 which is maintained whether the diaphragm is supported by the plate 150 or the member 130.

After the transducer assembly calibration the output assembly 34 is fixed in place to the transducer assembly 32 by a deformable clamping collar 170. The output assembly 34 comprises a switch 172, output terminals 174, 176 and a support housing 178. The housing 178 is a rigid dielectric plastic molded part having a barrel 180 surrounding the switch, an end flange 182 abutting the transducer assembly and engaged by the clamping ring 170 and a terminal supporting end 184 through which the terminals extend.

The switch 172 is formed by a nonmoving contact arm 190 adjustably supported by the housing end 184 and a moving contact arm 192. The moving contact arm 192 is formed by an electrically conductive leaf spring which carries a contact at its free end and is connected to the terminal 174 at its opposite end. The leaf spring is engaged by the pin 46 and when the diaphragm is snapped between its positions the leaf spring resiliently deflects to open or close the switch contacts.

The nonmoving contact arm 190 is formed by a leaf spring supporting a contact at its projecting end and fixed to the terminal 176 at its opposite end. An adjusting screw 194 is threaded in the housing end wall 184 and engages the nonmoving contact arm 190. That contact arm can be shifted by advancing or retracting the screw to accomodate for tolerance variations in the output and transducer assemblies.

Both the moving and nonmoving contacts are supported cantilever fashion by their respective leaf springs so that the snap closure of the contacts is cushioned and the contacts are able to roll slightly with respect to each other upon opening and closure of the contacts. Overtravel of the pin 46 causes resilient deflection of the springs improving the electrical continuity between the contacts and aiding abrupt separation of the contacts when they are disengaged.

The head of the screw 194 is recessed in the housing end 184 to isolate the screw from contact after adjustment of the nonmoving contact position. It should be noted that the motion transmitting pin 46 carries an end cup engaging the switch arm 192 which is formed of a dielectric material. This electrically insulates the transducer assembly from the switch contact arm 192.

The switch housing end flange 182 is formed with an annular locating land 196 which engages the locating face 92 on the transducer assembly when the transducer and output assembly are assembled together. This coaction assures accurate location of the assemblies relative to each other.

The assemblies are maintained forcibly urged together while the collar 170 is placed about the assembly and crimped to provide opposed collar lips **170*a*, 170*b* which engage the body member flange 62 and the switch housing flange 182**, respectively.

While a single preferred embodiment of the invention has been illustrated and described in detail the invention is not to be considered limited to the precise construction shown. Various modifications, adaptations and uses of the invention may become apparent to those skilled in the art to which the invention relates and the intention is to cover all such modifications adaptations and uses which come within the spirit or scope of the appended claims.

What is claimed is:

1. A pressure responsive control unit comprising:

(a) first and second rigid body members defining a chamber therebetween;

(b) a snap acting diaphragm extending through said chamber to provide first and second chamber sections on opposite sides of the diaphragm, said diaphragm defining an outer marginal section hermetically bonded to one of said body members and a dished central section which snap moves from one chamber section in a direction toward the other depending on differential pressure acting on the diaphragm; and, (c) a pressure event controlling mechanism comprising (i) a diaphragm support plate in one of said chamber sections, said support plate having an outer peripheral portion engaging said diaphragm marginal section and a resiliently deflectable central portion defining a smoothly concave face extending substantially continuously across said chamber and engageable at least in part by said diaphragm central section when dished toward said one chamber section;

(ii) an adjusting member reacting between said other body member and said support plate central portion, said adjusting member movable to resiliently deflect and move said support plate central portion relative to the support plate outer peripheral portion to govern the extent of diaphragm deflection toward said one chamber section and the differential pressure level at which said diaphragm snap moves away from said one chamber section;

(d) said body members defining bearing faces which tightly compress and support said marginal section and peripheral portion therebetween.

2. A pressure responsive control unit as claimed in claim 1 wherein one of said body members defines a rigid locating face, and further including an output assembly operable in response to movement of said diaphragm and including a housing member and connecting means for maintaining said housing member firmly engaged with and in fixed relationship to said locating face.

3. The pressure responsive control unit claimed in claim 2 wherein said output assembly further includes a switch supported by the housing member having a first contact which moves toward and away from engagement with a second contact in response to movement of said diaphragm central section and further including a switch actuator element for moving said first contact.

4. The pressure responsive control unit claimed in claim 1 further including a second pressure event controlling mechanism comprising:

(i) a diaphragm supporting member disposed on the opposite side of said diaphragm from said diaphragm support plate, said supporting member defining a diaphragm engaging portion, base portion fixed with respect to said one of said body members and an interposed deflectable portion; and, (ii) an adjusting member reacting between said diaphragm engaging poriton and said one of said body members for adjusting the position of said diaphragm engaging portion and controlling the differential pressure level at which said diaphragm moves away from said diaphragm engaging portion.

5. A pressure responsive control unit comprising:

(a) first and second rigid body members secured together to define a chamber therebetween;

(b) a snap acting diaphragm extending through said chamber to provide first and second chamber sections on opposite sides of the diaphragm, said diaphragm defining an outer marginal section hermetically bonded to one of said members, a circumferential corrugation extending about and within said chamber a dished central section surrounded by said corrugation which snap moves from one chamber section in a direction toward the other depending on differential pressure acting on the diaphragm; and, (c) a pressure event controlling mechanism comprising:

(i) a support plate in one of said chamber sections, said support plate having an outer peripheral portion clamped between said diaphragm marginal section and said other body member to immobilize said diaphragm outer martinal section at least adjacent the bond between said diaphragm and said one of said body members, and a resiliently deflectable central portion defining a smoothly concave face extending substantially across said chamber and engageable at least in part by said diaphragm central section when dished into said one chamber section, said support plate defining a narrow circumferential zone of bearing contact with said diaphragm along the inner periphery of said corrugation, said zone engaging said diaphragm continuously regardless of the direction of dishing of said diaphragm central section; and, (ii) an adjusting member engaged between said other body member and said support plate central portion and movable to resiliently deflect and move said support plate central portion relative to the support plate outer peripheral portion to control the extent of diaphragm deflection into said one chamber section.

6. The control unit claimed in claim 5 wherein said diaphragm corrugation projects from said diaphragm on the opposite side from said support plate and extends about said diaphragm closely adjacent the chamber wall, the juncture of said support plate outer peripheral portion and said central portion aligned with said corrugation and spaced away from contact with said diaphragm.

7. The control unit claimed in claim 5 wherein said support plate outer peripheral portion engages and supports the diaphragm immediately adjacent the outer periphery of the corrugation.

8. The unit claimed in claim 5 further including a second pressure event controlling mechanism having a diaphragm support member in said other chamber section, said diaphragm support member comprising a peripheral base portion fixed to said one body member, a medial portion defining a face for engaging and supporting the diaphragm central section when dished into said other chamber section, and a deformable resilient portion between said base portion and said medial portion.

9. The unit claimed in claim 4 further includes an adjusting member reacting between said one body member and said diaphragm support member, said adjusting member movable relative to said one body member to deform said deformable resilient portion and adjust the location of said medial portion relative to said diaphragm.

10. The unit claimed in claim 9 wherein said deformable resilient portion is defined by a corrugation in said diaphragm support member, said corrugation deformed by movement of said adjusting member toward said diaphragm and maintaining said medial portion resiliently engaged with said adjusting member.

11. A pressure responsive control unit comprising:

(a) first and second rigid structurally strong body members defining a chamber between them;

(b) a snap acting diaphragm having a generally circular marginal portion hermetically attached to one body member and a dished central section extending through the chamber;

(c) a diaphragm supporting plate having an outer peripheral portion aligned with the marginal diaphragm portion and a smoothly concave central portion resiliently movable relative to the outer peripheral portion and engageable with the diaphragm central section substantially throughout its extent when the diaphragm is dished toward the supporting plate;

(d) said first and second body members each formed from a rigid structurally strong material and defining a bearing face portion disposed circumferentially about the chamber, said bearing face portion of said one body member directly engaging said diaphragm and hermetically attached to said diaphragm along a narrow circumferential band, said other body member bearing face portion aligned with said narrow band and compressively engaged with the diaphragm supporting plate outer peripheral poriton, said body members further including clamping structure for maintaining said diaphragm and diaphragm supporting plate tightly compressed between said bearing faces;

(e) a motion transmitting element engageable with said diaphragm central section and extending through openings in said supporting plate and said other body member; and, (f) an adjusting member reacting between said other body member and said diaphragm supporting plate to resiliently deflect said supporting plate central portion to a pedetermined position with respect to said diaphragm central section.

12. The control unit claimed in claim 11 wherein said adjusting member is tubular and has external threads and is threaded into said opening in said other body member, said motion transmitting element extending through said adjusting member.

13. The control unit claimed in claim 11 wherein said adjusting member includes structure enabling its movement relative to said other body member when said body members are clamped together to control unit calibration.

14. A pressure responsive control unit comprising:

(a) first and second rigid body members secured together to define a chamber therebetween, each of said body members defining an opening extending to said chamber;

(b) a snap acting diaphragm between said members and extending through said chamber to provide first and second chamber sections on opposite sides of the diaphragm, said diaphragm defining a circular outer peripheral section bonded to one member and a dished central section which snap moves from one chamber section to the other depending on differential pressure acting on the diaphragm;

(c) a support plate in one of said chamber sections, said support plate having an outer peripheral portion clamped between said outer peripheral diaphragm section and said other body member and a stiffly resilient central portion defining a smoothly concave face engageable at least in part by said diaphragm central section when dished into said one chamber section; and (d) an adjusting member supported by said other body member and engaging said support plate central poriton, said adjusting member movable to resiliently deflect and move said support plate central portion relative to said support plate outer peripheral poriton to control the diaphragm deflection into said one chamber section said other body member rigidly supporting said support plate central portion in its adjusted position.

* * * * *